US005829213A

United States Patent [19]

Schulze et al.

[11] Patent Number: 5,829,213

[45] Date of Patent: Nov. 3, 1998

[54] CONCRETE SLAB SAVER

[76] Inventors: Clayton E. Schulze; Todd M. Schulze, both of 8282 McKee Rd., Albion, Pa. 16401

[21] Appl. No.: 432,904

[22] Filed: May 1, 1995

[51] Int. Cl.[6] ..... E04B 1/62; E04B 5/00; E04B 2/00

[52] U.S. Cl. ..... 52/254; 52/127.1; 52/287.1; 52/717.05; 52/745.11

[58] Field of Search ..... 52/254, 273, 287.1, 52/601, 745.2, 745.11, 102, 127.1, 717.05, 716.1, 255

[56] References Cited

U.S. PATENT DOCUMENTS

| | | | |
|---|---|---|---|
| 710,880 | 10/1902 | McDonald | 52/254 |
| 857,775 | 6/1907 | Walter | 52/254 |
| 4,585,131 | 4/1986 | Crossman et al. | 52/287.1 X |

FOREIGN PATENT DOCUMENTS

| | | | |
|---|---|---|---|
| 0553060 | 12/1956 | Belgium | 52/254 |

*Primary Examiner*—Robert Canfield
*Attorney, Agent, or Firm*—Pettis &Van Royen P.A.

[57] ABSTRACT

A device and method for eliminating scaring and damage to a concrete slab floor during the erection and placement of the associated surrounding concrete walls.

4 Claims, 2 Drawing Sheets

16
12
12
12
13
14
18
14
14
10
13
10
10

CONCRETE SLAB SAVER

BACKGROUND OF THE INVENTION

1. Field of the Invention

The present invention relates to a pre-cast panel insert used to protect the surrounding areas, particularly the floors, while the precast walls are being placed during tilt/wall construction.

2. Description of the Prior Art

During the construction and erection of concrete buildings by use of the method commonly referred to as "Tilt/Wall Construction", the movement of the wall units across the existing concrete floors for placement as building walls usually causes extensive damage to the building's concrete floor when the walls are moved and erected into place.

Typically, when Tilt/Wall construction is employed, each concrete wall is formed and poured on top of the building's concrete slab floor. After the wall has hardened, it is moved (i.e., tilted and slid along the floor) to its designated location. The sliding process generally results in significant scaring and damage to the concrete floor caused by the lower outside corner of the wall contacting the concrete floor. The resultant damage to the concrete floor must then be repaired at the expense of additional time, labor, materials, and associated Costs.

SUMMARY OF THE INVENTION

The present invention comprises a slab saver device, that is imbedded into the bottom outside corner of a concrete wall when the wall is formed. Subsequently, when the wall is lifted, tilted, and slid along the floor to its designated location, the device is the only portion of the wall that comes in contact with the floor. The device, because it is composed of a material that is softer than the concrete, protects the floor from damage.

DESCRIPTION OF A PREFERRED EMBODIMENT

Figure 2:
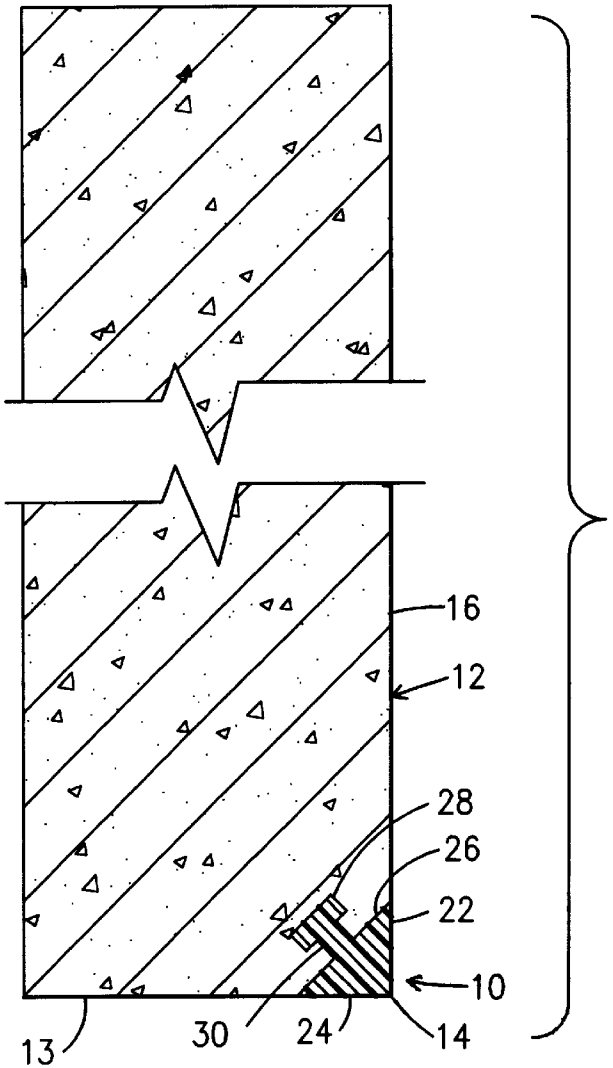
FIG. 2 is a cross-sectional view of the device of FIG. 1 illustrating the device embedded within the bottom outside corner of a wall slab.
Figure 1:
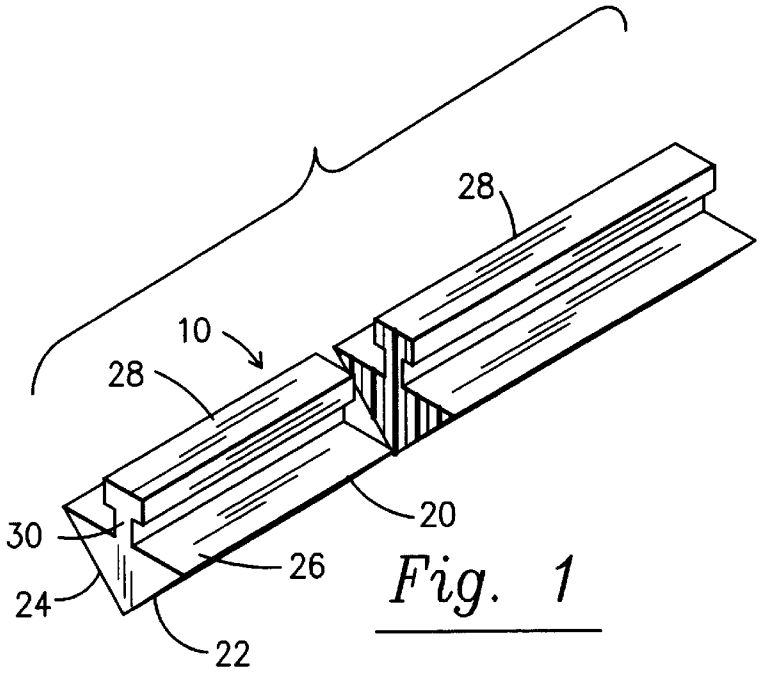
FIG. 1 is a perspective view of the device of this invention.
Figure 3:
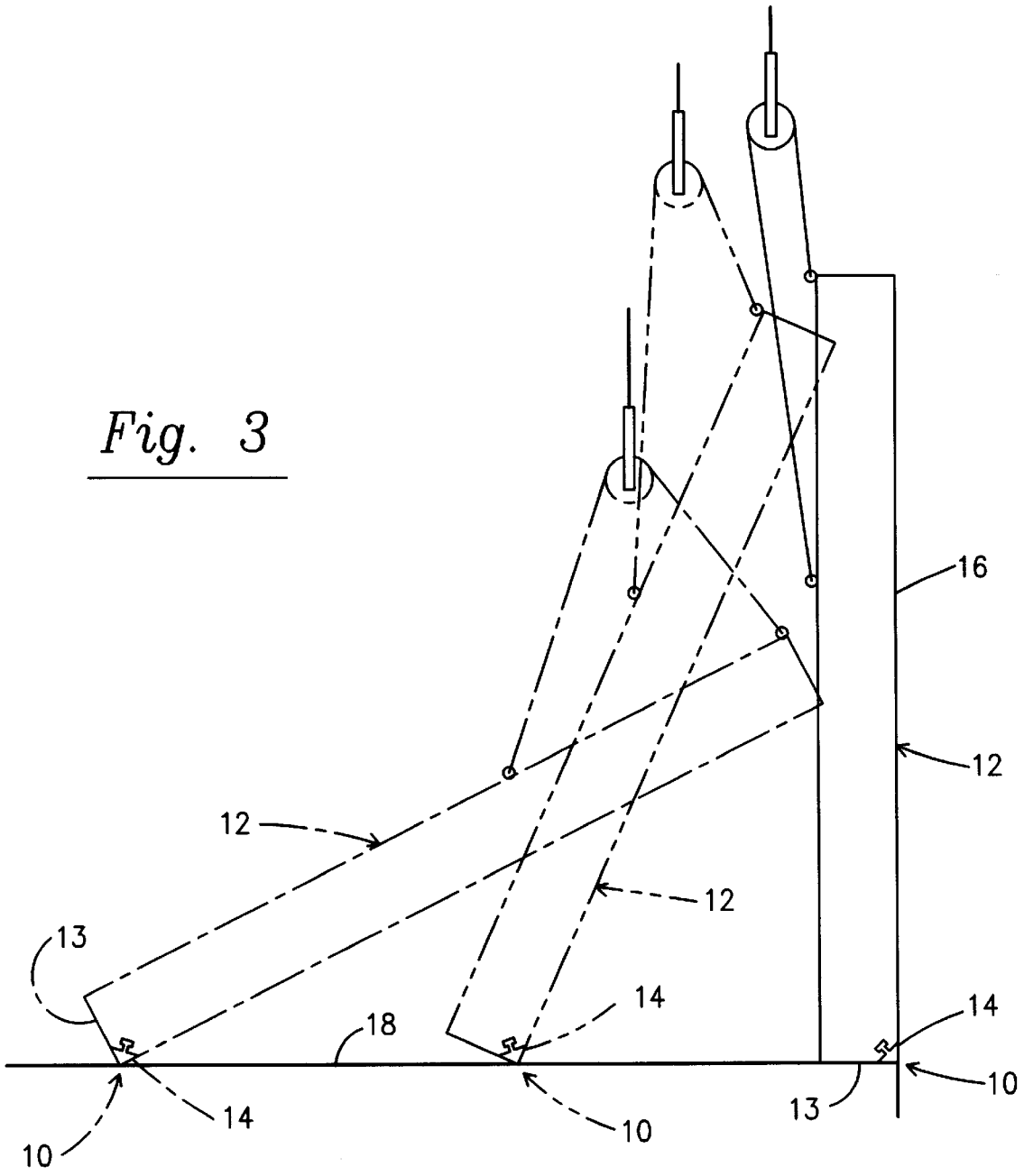
FIG. 3 is an end view of the device of FIG. 1 shown embedded within a wall illustrating the process of lifting, tilting, and sliding the wall on the floor to its designated location.

FIGS. 1–3 illustrate a preferred embodiment of a device generally indicated as 10, for protecting a concrete floor during the erection of a building's concrete walls 12. The device 10 is placed into the bottom outside corner 14 of each concrete wall 12 when the wall 12 is formed. As shown in FIG. 3, it can be seen that the bottom outside corner 14 is in relation to the outside of the building, generally 16, when the wall 12 has been erected and FIG. 3 illustrates the placement and location of the device 10 within the concrete wall 12.

The device 10 may be constructed of any material that exhibits the following characteristics: (1) is strong enough to withstand the weight of the concrete wall 12, in which the device 10 is inserted, without breaking when the wall 12 is tilted and slid into place; and (2) is softer than concrete, such that the device 10 will not scratch, dent, or otherwise mar the surface of the concrete floor 18 when the corner 14 of the wall 12 is dragged along the floor 18 as the wall 12 is slid into peace. In a preferred embodiment, a material such as polypropylene is pre-cast to the configuration shown in FIG. 1, The device 10 is then placed into the bottom outside corner 14 of the wall 12 when the concrete for the wall 12 is poured into the wall's form. When the concrete is subsequently cured, the wall 12 can be lifted, tilted, and slid on the device 10 without damaging the floor as illustrated in FIG. 3. The device 10 also acts as a permanent outside corner edge for the bottom 13 of the wall 12 once the wall 12 is positioned in its designated location.

The shape of a preferred embodiment of the device 10 is illustrated in FIG. 1, where it comprises a longitudinally extending member 20 that has a first side 22, a second side 24 and a third side 26. A projection, shown generally as 28, extends outwardly from one of the sides, side 26 as illustrated. The projection 28 is formed in the shape of a "T", with the stem 30 being attached to the member 20. As shown in the embodiment illustrated in FIG. 1, the projection 28 is preferably formed contiguously with the member 20. The member 20 must be large enough and strong enough to support the full weight of the concrete wall 12 without breaking when the wall 12 is tilted and slid along the concrete floor 18. The projection 28 forms a "KEY" in the concrete wall 12 which is used to secure the device 10 firmly in place within the bottom outside corner 14 of the wall 12. The sides 22 and 24 of member 20 will thus form the bottom outside corner 14 of the wall 12.

While we have illustrated and described the preferred embodiment of our invention, it is understood that we do not limit ourselves to the precise construction herein disclosed and the right is reserved to all changes and modifications coming within the scope of the invention as described in the appended claims.

Having thus described our invention,

What is claimed is:

1. A system comprising a concrete floor and a device used in combination with a concrete wall panel, constructed and placed during construction of a building in accordance with tilt/wall construction methods, to protect the concrete floor over which the wall panel is dragged during construction, said device comprising:

a longitudinally extending member forming a longitudinally extending bottom corner of a wall panel in tilt/wall construction, said member being attached to said wall panel in engaging relation to said concrete floor, and said member being comprised of material softer than said concrete floor such that damage to said concrete floor is reduced during movement of said wall panel across said concrete floor.

2. A device as in claim 1, wherein said device is comprised of a synthetic resin formulated to be softer than said concrete floor over which the wall is dragged.

3. A device as in claim 1, wherein said device is comprised of polypropylene formulated to be softer than said concrete floor over which the wall is dragged.

4. A device as in claim 1, comprising at least one projection extending from said member, said projection being formed in a "T" shape, including a stem that is attached to said member.

* * * * *